US007131506B2

(12) United States Patent
Hamilton et al.

(10) Patent No.: US 7,131,506 B2
(45) **Date of Patent: *Nov. 7, 2006**

(54) FLIGHTLESS ROCK AUGER FOR USE WITH PRESSURE DRILLS WITH QUICK ATTACHMENT AND METHOD OF USE

(75) Inventors: Gary Wayne Hamilton, New Haven, KY (US); Charles Hamilton, Bardstown, KY (US)

(73) Assignee: Gator Rock Bits, Inc., New Haven, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/664,604

(22) Filed: Sep. 16, 2003

(65) Prior Publication Data

US 2004/0144572 A1 Jul. 29, 2004

Related U.S. Application Data

(63) Continuation-in-part of application No. 10/032,216, filed on Dec. 20, 2001, now Pat. No. 6,619,413, and a continuation-in-part of application No. 09/684,821, filed on Oct. 10, 2000, now Pat. No. 6,494,276, which is a continuation-in-part of application No. 09/066,194, filed on Apr. 24, 1998, now Pat. No. 6,129,163.

(60) Provisional application No. 60/203,061, filed on May 9, 2000, provisional application No. 60/185,664, filed on Feb. 29, 2000.

(51) Int. Cl.
*E21B 10/00* (2006.01)
*E11B 17/14* (2006.01)

(52) U.S. Cl. ..... 175/403; 175/402; 175/320; 408/204; 408/238

(58) Field of Classification Search ..... 175/402–404, 175/385, 386; 408/204, 206, 207, 238
See application file for complete search history.

(56) References Cited

U.S. PATENT DOCUMENTS 2,021,184 A * 11/1935 Hill ..... 175/403

(Continued)

FOREIGN PATENT DOCUMENTS

| | | |
|---|---|---|
| DE | 37 05 717 A1 | 9/1998 |
| GB | 2 040 741 A | 9/1980 |

*Primary Examiner*—Frederick L. Lagman
(74) *Attorney, Agent, or Firm*—Carrithers Law Office PLLC; David W. Carrithers

(57) ABSTRACT

A flightless rock auger is used for drilling postholes through rock with the use of hydraulic pressure and at slow revolution per minute. The rock auger is used in combination with a conventional flighted auger used for drilling postholes in dirt and clay. During a posthole drilling operation, the rock auger is substituted for a conventional flighted auger as needed for drilling through and removing rock or other hard material such as concrete from the posthole. The rock auger is designed for use at very low revolutions per minute and can function utilizing only the weight of the auger; however, the rock auger is designed for use with pressure drilling units as well for cutting a circular hole through the rock and forming a plug which is to be lodged in the cavity of the rock auger cylinder to be removed from the posthole. The quick connection enables the shaft of a pressure drill unit to engage the flightless auger to be quickly substituted for the rock auger to facilitate fast removal of soft dirt from the posthole. A pilot drill bit can be disposed within the cutting head for extending outwardly pass the cutting edge thereof for starting the hole, breaking up rock, and holding the auger in position during the drilling operation. A portion of the cylindrical body can be removed to allow quick clearance of the plug.

16 Claims, 14 Drawing Sheets

U.S. PATENT DOCUMENTS 3,360,285 A * 12/1967 Huckshold ..... 403/292
3,854,840 A * 12/1974 Miyanaga ..... 408/204
4,077,737 A * 3/1978 Morse ..... 408/206
4,101,238 A * 7/1978 Reibetanz et al. ..... 408/204
4,228,862 A 10/1980 Causse
4,458,949 A 7/1984 Jury
4,968,101 A 11/1990 Bossow
5,054,971 A 10/1991 Kieninger et al.
5,597,274 A * 1/1997 Behner ..... 408/204
5,651,646 A 7/1997 Banke et al.
5,791,837 A * 8/1998 Johnson ..... 408/204
5,803,677 A 9/1998 Brutscher et al.
5,842,820 A 12/1998 Lee et al.
6,129,163 A * 10/2000 Hamilton et al. ..... 175/403
D441,380 S 5/2001 Hamilton et al.
6,273,652 B1 8/2001 Wirth, Jr. et al.
D457,535 S 5/2002 Hamilton et al.
6,494,276 B1 * 12/2002 Hamilton et al. ..... 175/403
6,619,413 B1 * 9/2003 Hamilton et al. ..... 175/403

* cited by examiner

FLIGHTLESS ROCK AUGER FOR USE WITH PRESSURE DRILLS WITH QUICK ATTACHMENT AND METHOD OF USE

This is a Continuation-In-Part of U.S. application Ser. No. 10/032,216 filed on Dec. 20, 2001 now U.S. Pat. No. 6,619,413 , which is a Continuation-in-Part of Ser. No. 09/684,821 file on Oct. 10, 2000 now U.S. Pat. No. 6,494,276 which is a Continuation-In-Part of Ser. No. 09/066,194 filed on Apr. 24, 1998, now U.S. Pat. No. 6,129,163 and claims priority from U.S. Provisional Applications Ser. No. 60/203,061 filed on May 9, 2000 and Ser. No. 60/185,664 filed on Feb. 29, 2000.

BACKGROUND OF THE INVENTION

The present invention relates to a flightless rock auger suspended from a derrick and powered by a shaft linked to a power source for removing plugs of rocks from post holes.

Poles for power lines and communication purposes are required to be vertical and arrange din straight lines. The poles may be planted in positions which are relatively inaccessible. A crane may be utilized for providing an outreaching means. Typically a digger derrick consists of a telescopic mobile crane from which is suspended a torque head. A flighted auger is suspended from the torque head and utilized for drilling in soil containing loose rock. The digger derrick is advantageous for extending the auger to the desired location. The auger may be stowed in a fixed position or extended in a telescoping position as needed to reach the desired location for drilling the hole.

Depending on the nature of the digging device, its digging element, or auger, torque head or hydraulic pressure is typically exerted on the digging element via air or oil hydraulic pressure exerted by the crane or cylinder in cooperative engagement therewith for forcing the digging element into the earth.

Although the conventional flighted auger is adequate for drilling through soil, or even soil with loose rock, the drilling operation must be suspended upon hitting a large rock or rock ledge because the flighted auger cannot penetrate the hard rock surface. The flighted auger is then lifted out of the hole and conventional methods of removing the obstruction with a steel shaft, crowbar, or explosive charge are used to break-up the hard rock. The flighted auger is then lowered into the hole to remove the loose rock.

A considerable amount of time is lost during the rock break-up and removal procedure. Moreover, an effort is continually being made to minimize work with explosives due to the liability of injury to workers and/or damage to residents or businesses in the area which may be in the area of the blasting zone and susceptible to rock or vibration damage.

SUMMARY OF THE INVENTION

The present invention achieves the above objects by providing a flightless rock auger for drilling postholes through rock and hardpan.

The present invention provides a flightless rock auger having a cylindrical hollow cutting head and a plurality of teeth extending from the lower periphery thereof. A support member extends across a portion of the cylindrical hollow cutting head providing a means for cooperative engagement with a shaft extending outwardly therefrom. A quick disconnect coupling is disposed upon the distal end of the shaft or in the case of the pressure digger unit a connection is formed at the top of the body for cooperative engagement with the shaft of a pressure digger, usually of square or hexagonal or octagonal configuration.

One preferred embodiment of the flightless rock auger system for use with a drilling rig includes a flightless rock auger having a cylindrical hollow cutting head with a plurality of cutting teeth extending from the bottom edge of the cutting head. A support member extends across a portion of the cylindrical hollow cutting head providing a means for cooperative engagement with a vertical drive shaft extending outwardly therefrom. A quick disconnect coupling is disposed upon the distal end of the shaft. A means for rotating the drive shaft such as a mechanical or fluid drive may also power the hydraulic mechanism for lifting and lowering the drive shaft which may utilize its own weight for exertion of downward pressure onto the hard substrate. Embodiments utilizing a coupling affixed directly to the top of the cutting head are well suited for use with pressure drilling rigs whereby force may be applied to the auger to provide quicker drilling.

A method of removing hard substrate from a posthole, using a flightless rock auger with a drilling rig simply requires the attaching a flightless rock auger having a cylindrical hollow cutting head and a plurality of cutting teeth extending from the bottom edge of the cutting head. A support member extends across a portion of the cylindrical hollow cutting head providing a means for cooperative engagement with a vertical drive shaft extending outwardly therefrom formed integrally therewith, or disposed therein from a pressure drill.

On the shaft models, a quick disconnect coupling is disposed upon the distal end of the shaft to means for rotating the drive shaft. On some pressure drilling flightless rock augers the shaft of the pressure drill rigs cooperatively engage a coupling mounted to the top of the auger body with a reinforced connections. The flightless rock auger is lowered into a posthole containing a hard substrate and resting the flightless rock auger onto the hard substrate. The auger is rotated at a very low rpm of up to 60 rpm, but more preferably up to 30 rpm and most preferably in a range of from between about 3 rpm to about 10 rpm forming a plug of hard substrate inside of the cylindrical body of the flightless rock auger. Lifting the flightless rock auger and the plug from the posthole is simple and the plug of the hard substrate is removed from the flightless rock auger head. The flighted auger is then substituted for removing soil from the posthole.

The flightless rock auger comprises a cylindrical head defining a plurality of teeth extending downwardly from the periphery of the bottom edge at a selected forward angle. The top of the head is connected to a shaft having a quick disconnect adapter.

The rock auger is utilized in combination with a conventional flighted auger used for drilling postholes in dirt and clay. During a posthole drilling operation, the rock auger is substituted for the flighted auger when needed to drill through and remove rock or other hard material such as concrete from the posthole. The rock auger is designed for use at very low revolutions per minute and can utilize only the weight of the auger and shaft and does not require any additional hydraulic pressure for cutting a circular hole through the rock and forming a plug which is be lodged in the cavity of the rock auger cylinder to be removed from the posthole. Of course, most trucks or drilling rigs are equipped with hydraulic means for exerting pressure on the cutting head to increase the cutting rate and is often utilized with the shaft and cutting head and usually utilized with the pressure drilling head having a quick disconnect near the top of the cutting head body. The quick connection shaft enables the conventional flighted auger to be quickly substituted for the flightless rock auger to facilitate fast removal of soft dirt from the posthole. The rock auger provides a means for utility companies to utilize a means for drilling postholes for electric poles, telephone poles, pilings, and the like without the use of explosives; thereby providing a safer means of excavation.

When the drilling operation encounters rock, rather than blasting through the rock with explosives, the flightless rock auger can be fitted onto the torque head of a conventional drilling shaft and used to drill through the rock. A plug may be formed in the head by the drilling operation; however, the plug is removed by using had tools which fit into openings formed in the top end of the drilling head, or be forced through a side opening thereof.

A preferred embodiment of the present invention includes at short or long shaft extending from the body with a quick disconnect distal end, a cylindrical body and drill head having a greater diameter than the body wherein a plurality of teeth extend downward at an angle from the outer edge of the drill head.

More particularly, the flightless rock auger is designed for removing plugs of hard material from post holes. The rock auger includes a cylindrical hollow cutting head having a hollow cylindrical body defining side walls connecting a top end defining an upper peripheral edge and a lower open end defining a lower peripheral cutting edge including a plurality of teeth extending from the lower peripheral edge. The top end of the hollow cylindrical body can include at least one support member extending across at least a portion of the top end joining the side walls. A shaft having a diameter less than the cutting head includes a proximal end connecting to the at least one support member and having an opposing distal end extending therefrom, whereby the shaft is integrally connected to the auger body, or in the case of the pressure drill embodiment, cooperatively engages the connection at the top of the hollow cylindrical body. The long shaft quick disconnect coupling disposed upon the opposing distal end of the shaft may include means for a floating providing limited vertical movement therebetween which may consist of a coupling having a slotted attachment joint or other connection allowing for some play within the coupling, or the coupling may use a pin extending though a corresponding shaped and sized hole through the shaft and coupling to provide a tight fit and limited movement.

Of course, the power drive shaft of the auger drive unit can also be connected to the shaft of the auger by a coupling which limits or even eliminates any play and provide a tight cooperative engagement therebetween. The auger and cutting head will still float in that only the weight of the auger will be necessary to cut through the rock substrate. If desired the cutting may be faster by also letting the power drive boom weight rest on the auger thereby floating on the rock substrate during the drilling process. Of course, applying downward pressure to the auger by use of the boom is an option to increase the cutting rate; however, unnecessary to obtain good performance. Thus, the pressure drill model provides rapid cutting motion through the substrate.

In summary, the present invention provides for an apparatus for use in cutting a plug from hard material of the Earth's surface including rock and like to make a post hole in the material. The apparatus comprises a drive shaft having a longitudinal axis, means at one end of the drive shaft for connecting the same to a power driven unit and a cutting head mounted on and projecting from an end of shaft opposite the one end. The cutting head including a side wall defining a tubular body disposed co-axial with the drive shaft and terminating in a free outer end spaced a selected distance from the end of the shaft opposite the one end. A plurality of teeth mounted on the wall and extending from the free end thereof in an array about the periphery of an opening of selected diameter into a cavity defined by the side wall. The cavity is of a selected depth for receiving therein a plug cut from the material by the teeth as the tubular body is rotated about the axis. In a preferred embodiment, a side wall having at least one opening extending therethrough includes an edge having a length in a direction parallel to the axis for scraping debris from the wall of the post hole during rotation of the cutting head about the axis.

Accordingly, it is a principal object of the present invention to provide a flightless auger device for digging through hard rock.

It is another object of the present invention to provide an flightless auger which is capable of drilling through rock and forming a plug removable from the flightless auger.

It is another object of the present invention to provide a flightless auger utilizing an attachment means which is interchangeable with the attachment means typically used with conventional flighted augers for drilling operations.

It is therefore another object of the present invention to design a flightless auger for use at very low revolutions per minute (rpm) to maximize safely and prevent damage to the equipment.

It is an object of the present invention to provide an adapter extending from a shaft for use with a torque head of a drilling derrick.

Another object is to provide a flightless auger having teeth extending outward at a forward angle.

It is another object to provide a flightless auger having a drill head portion utilizing an end diameter of greater diameter than the plug receiving inner diameter.

It is yet another object of the present invention to utilize a plurality of diagonal ribs to minimize suction between the exterior of the drilling head and the walls of the drilled hole.

It is yet another object of the present invention to provide an access port in the top end of the drilling head for removal of the rock plug formed therein.

BRIEF DESCRIPTION OF THE DRAWINGS

A better understanding of the present invention will be had upon reference to the following description in conjunction with the accompanying drawings in which like numerals refer to like parts throughout the several views and wherein.

DETAILED DESCRIPTION OF THE PREFERRED EMBODIMENT

Figure 3:
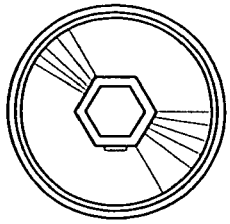
FIG. 3 is a top view of the invention of FIG. 1.

The flightless rock auger 10 with quick attachment coupling 11 of the present invention is manufactured from readily available materials and simple in design. The preferred embodiment is comprised of metal, more particularly steel. The rock auger 10 is mounted on construction equipment such as hydraulic drilling rigs. A drive shaft 12 in communication with a drilling rig motor 14 or circulation of a hydraulic fluid from a pump on the drilling rig 16 may be used to drive the hydraulic motor 18 of the construction equipment.

Referring now to the drawings, FIGS. 1–8 refer to the present invention including a standard drive shaft 12 utilizing a quick disconnect coupling 11 extending from the distal end 13 of the shaft 12. The shaft 12 is centrally aligned with the axis of the hollow cylindrical body 20 and secured to the proximal end, or top end of the cutting head 24 opposite the open end 26 having the cutting or a sraping edge. The top end is at least partially enclosed by a cross member 21 to provide structural strength. One or more reinforcements member such as the triangular members 28 may be welded to the shaft 12 and the top cross member 21 of the cutting head 24 to provide additional lateral and rotational strength.

Figure 4:
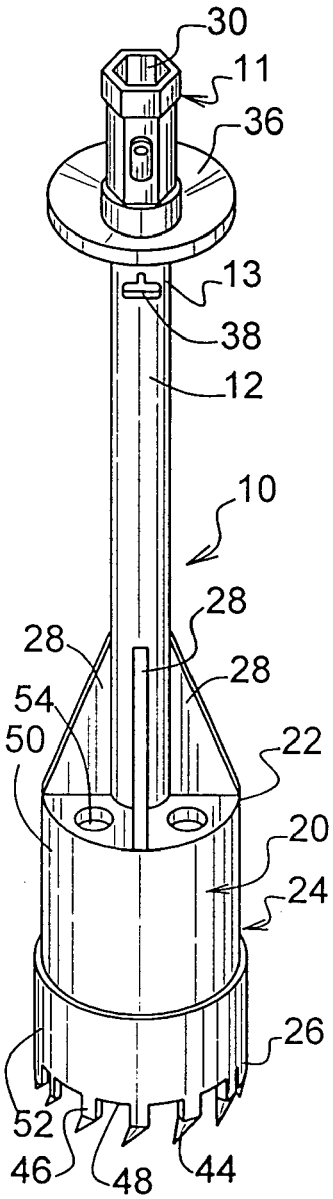
FIG. 4 is a perspective view of the invention of FIG. 1.
Figure 1:
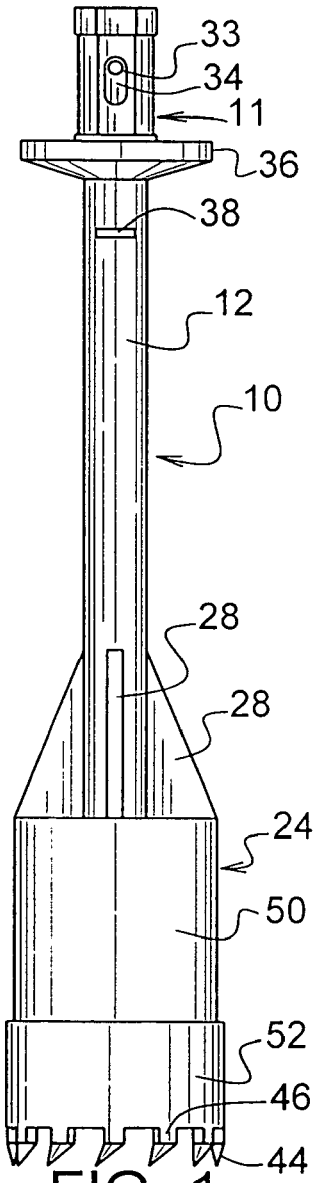
FIG. 1 is a front perspective view of the present invention showing the flightless rock auger with a shaft, and a cylindrical body forming a drill head with a plurality of teeth extending form from the outer edge of the drill head.
Figure 2:
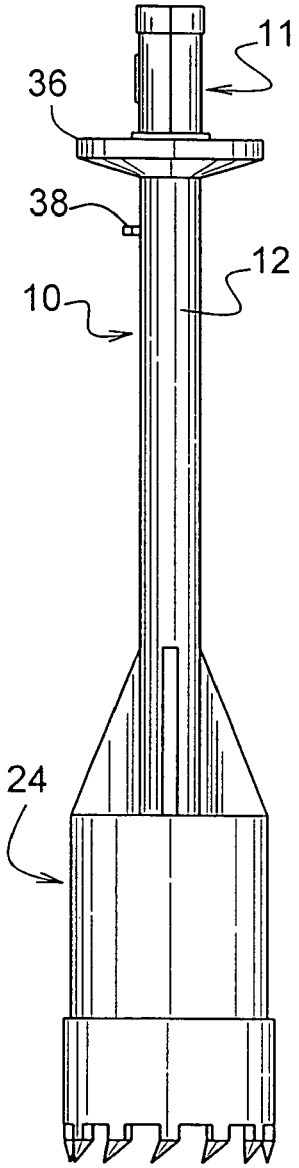
FIG. 2 is a side perspective view of the invention of FIG. 1.
Figure 5:
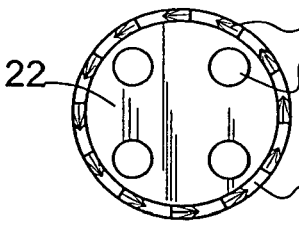
FIG. 5 is a bottom view of the invention of FIG. 1.
Figure 6:
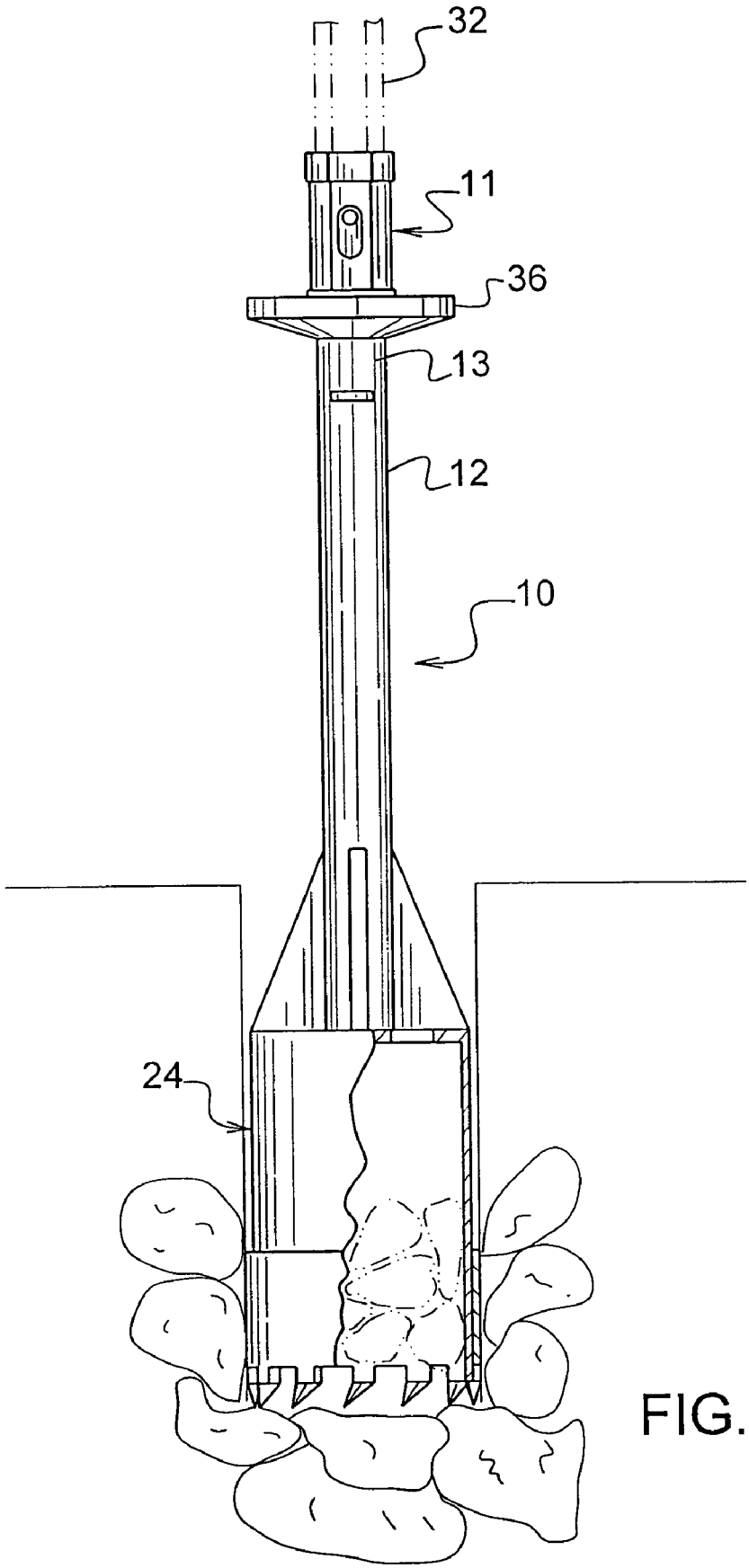
FIG. 6 is a partial cutaway view of the invention of FIG. 1 shown drilling through rock forming a plug therein.
Figure 7:
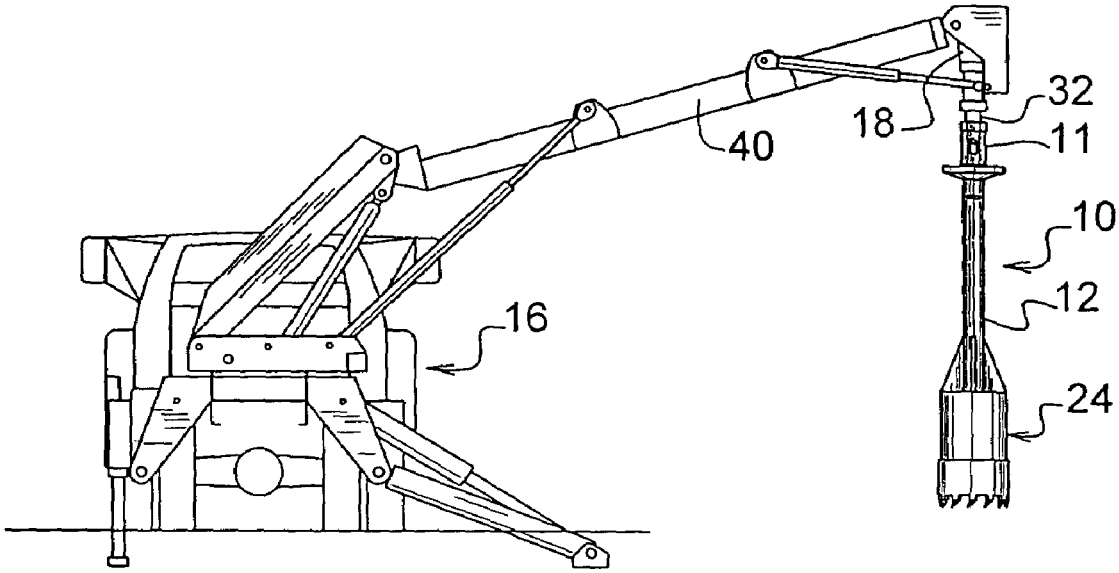
FIG. 7 is a perspective view of an embodiment of a mobile drilling rig utilizing the present invention.
Figure 8:
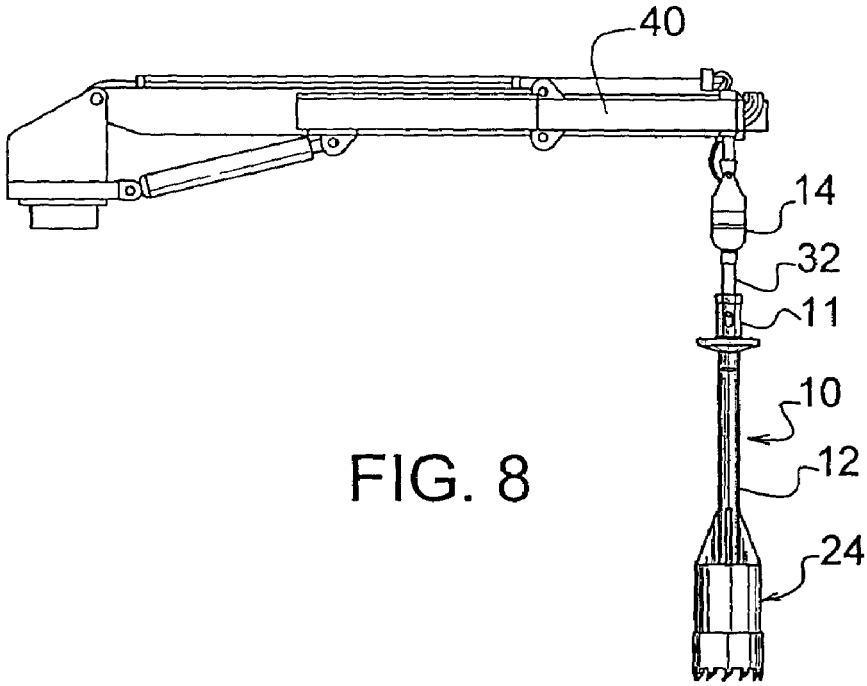
FIG. 8 is a perspective view of another embodiment of a life assembly suspending the present invention above the ground.
Figure 11:
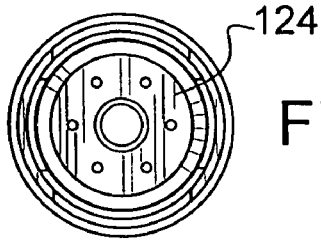
FIG. 11 is a top view of the flightless rock auger embodiment of FIG. 9.
Figure 12:
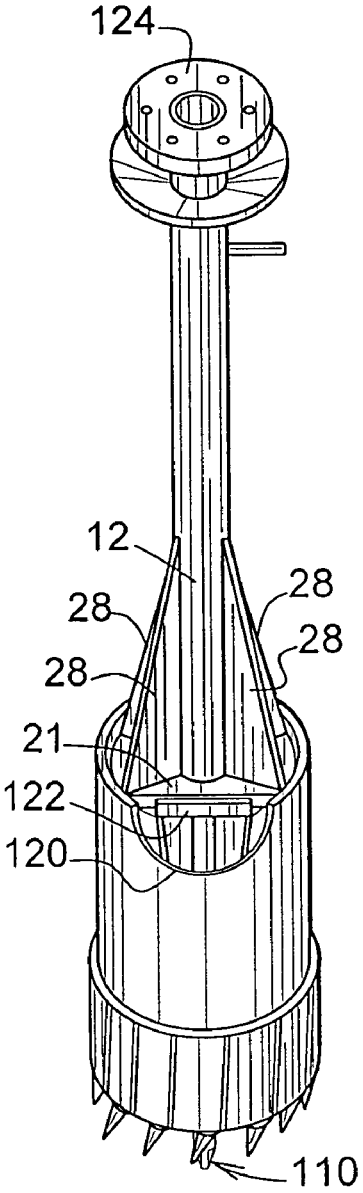
FIG. 12 is a perspective view of the flightless rock auger embodiment of FIG. 9 showing the pilot bit attachment through the access port in the top of the cylindrical body.
Figure 9:
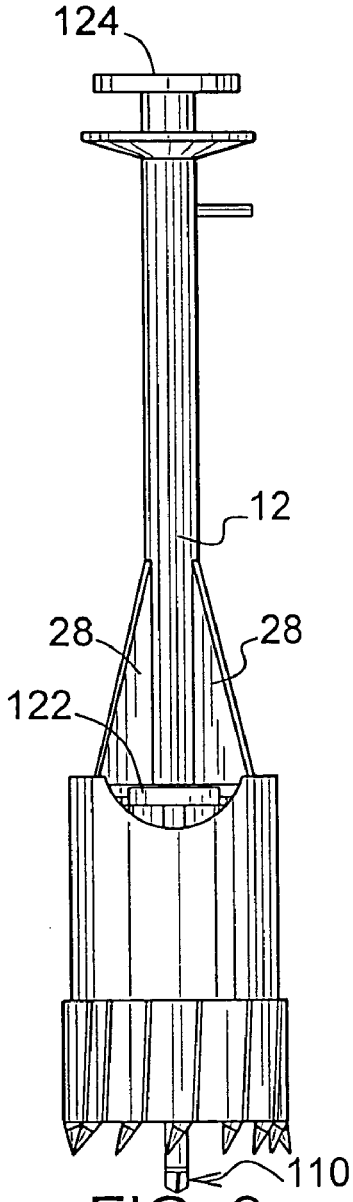
FIG. 9 is a perspective front view of an alternate embodiment of a flightless rock auger showing a cutting head of a flightless auger including a pilot bit centered within the cylindrical body extending past the cutting teeth.
Figure 10:
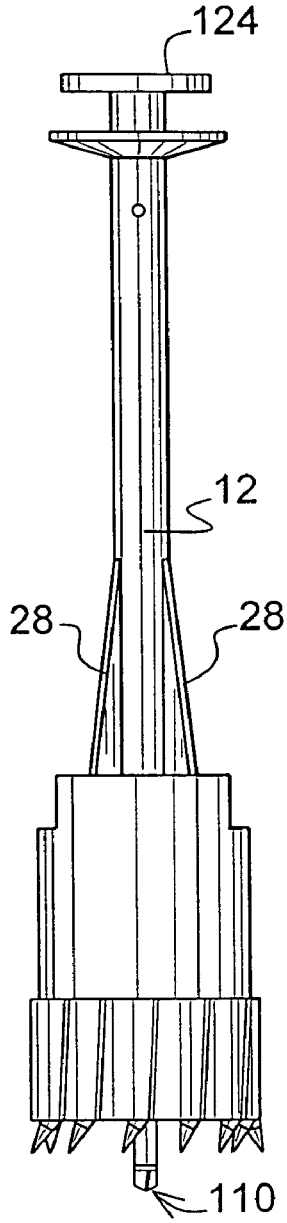
FIG. 10 is a perspective side view of the embodiment of the flightless rock auger of FIG. 9.
Figure 13:
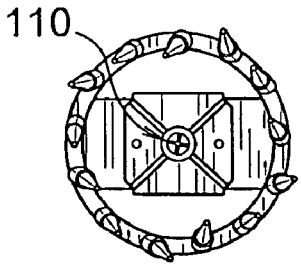
FIG. 13 shows a perspective bottom view of the flightless rock auger embodiment of FIG. 9.
Figure 14:
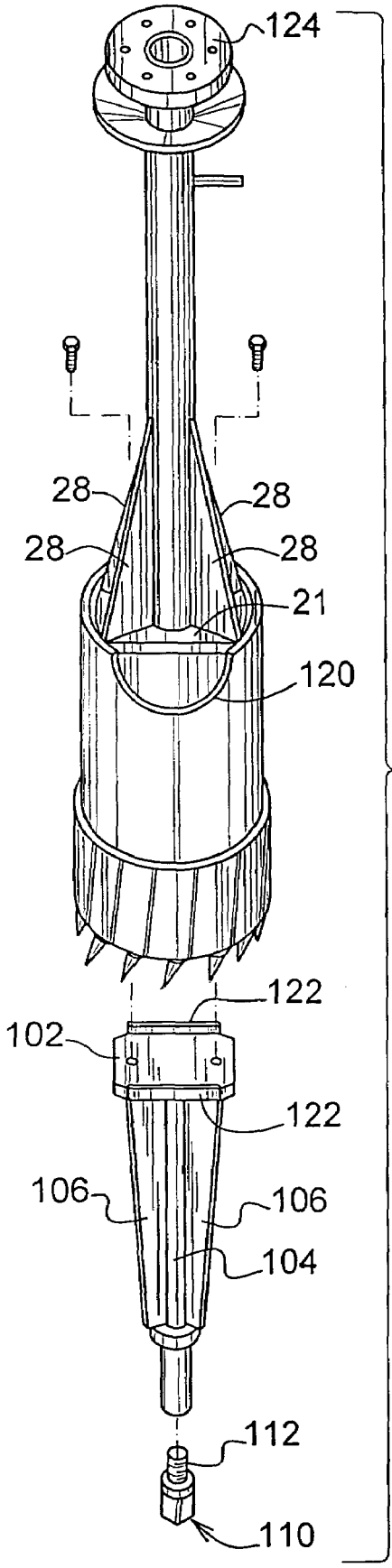
FIG. 14 is an exploded perspective view of the flightless rock auger embodiment of FIG. 9 showing the pilot bit shaft and tip.
Figure 15:
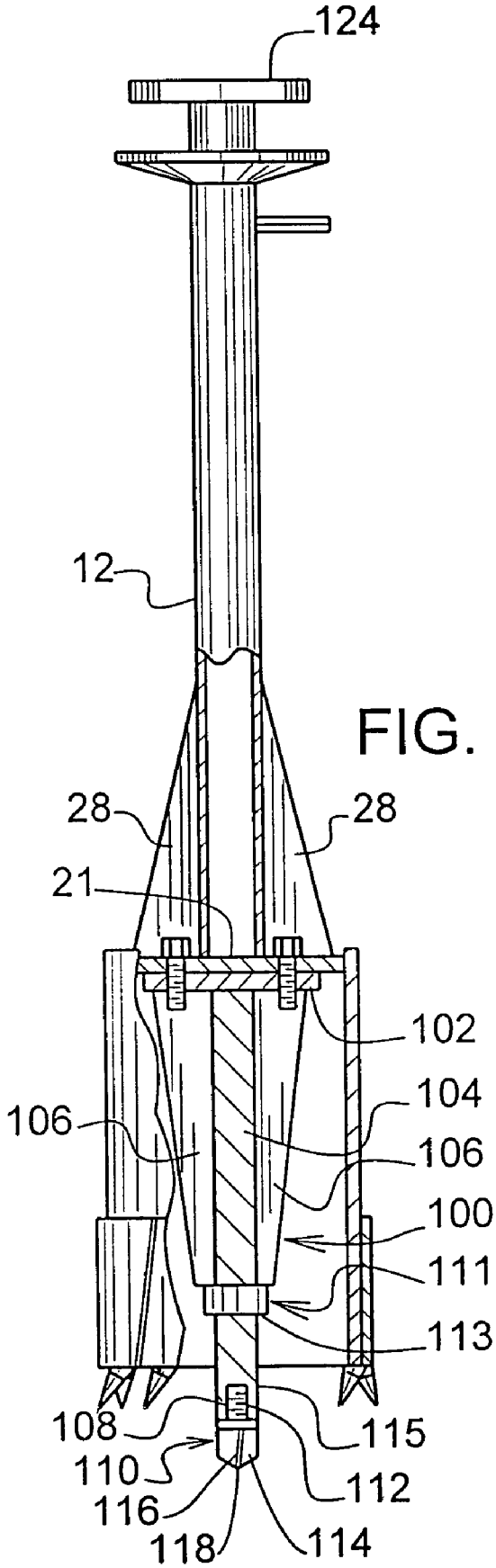
FIG. 15 is a cutaway perspective view of the flightless rock auger embodiment of FIG. 9 showing the pilot bit therein.
Figure 18:
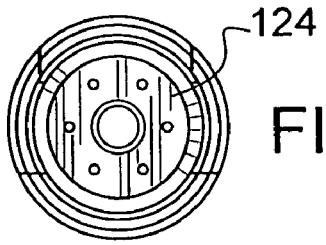
FIG. 18 is a perspective top view of the flightless rock auger embodiment of FIG. 16

As shown in FIGS. 3 and 4, the distal end 13 of the shaft 12 is typically tubular having a circular cross-sectional dimension, wherein a quick disconnect cylindrical coupling 11 may be welded, pressed, screwed, or friction fitted to the distal end 13 of the shaft 12. The cylindrical coupling 11, preferably is shaped having a female socket end 30 for cooperative engagement with the male end of a drive shaft 32 of a motor 14 or pump drive unit 18. A pin 33 may extend through the female socket end 30 and drive shaft 32 to provide the cooperative engagement; however, the preferred embodiment utilizes a coupling having a female socket end 30 sized and having a selected cross-sectional shape, to mate with a male drive shaft 32 having a square, hexagon, octagon or other shape for providing additional stability, rigidity, and stability to the connection therebetween. Moreover, a preferred embodiment can include a pin 33 which slides through a vertically disposed key way slot 34 to secure the quick connect coupling 11 to the drive shaft 32 of the drilling rig 16 permitting limited vertical movement therebetween as best shown in FIG. 3 or the slot may be in the form of a hole or corresponding shape and size of the pin 33 to minimize play A protective collar or flange 36 may extend circumferentially around the coupling 11. A key 38 may be inserted into a groove or orifice in the shaft 12 to provide an alignment indicator so that a user standing below the drilling boom 40 can look upward and align the key way slot 34 of the rock auger with the key way of the pump motor drive shaft 32 for quick coupling of the units. The key 38 also provides an easy means to count the revolutions per minute of the auger 10.

The rock auger can have a connecting collar defining a flange 124 for connecting to a complimentary power drive flange and a protective flange circumscribing the shaft therebelow to protect the users.

The cutting head 24 is formed from a hollow cylindrical body 20 open at its lower open end 26. A plurality of conical shaped teeth 44 extend from generally rectangular shaped projections 46 extending from the outer peripheral edge 48 of the cutting head body 20. The conical shaped teeth 44 are equally spaced apart and angled slightly in a forward direction. The teeth 44 may also be angled inwardly or outwardly slightly to protrude pass the peripheral edge 48 of the hollow cylindrical body 20. For instance, the series of teeth 44 at the bottom edge of the hollow cylindrical body 20 may be alternately inwardly and outwardly displaced from the plane of the hollow cylindrical body 20. The displacement of the teeth 44 is such that the cut or kerf made in the rock or other hard substrate is slightly wider than the thickness of the hollow cylindrical body 20 to aid in extraction of the cutting head 24 from the hard substrate. The teeth 44 may also be provided with additional material so that each tooth is wider than the thickness of the side walls of the hollow cylindrical body 20.

One preferred hollow cylindrical body embodiment comprises an upper section 50 and lower section 52, wherein the lower section 52 defines a greater exterior diameter than the upper section 50 to facilitate removal of the cutting head 24 from the posthole and reduce or prevent binding during the drilling process. Moreover, a hole, slot, slit or other opening 51 is optionally cut or formed into the upper section 50 to allow water to exit the head during the cutting operation and avoid causing a suction making removal of the rock plug difficult.

The flightless auger 10 is designed for interchangeable use with a conventional flighted auger used for removal soil from the post holes. The quick disconnect feature of the flightless auger 10 makes the interchangeable augers practical to use together without wasting time. Upon hitting a hard substrate such as a rock ledge, the flighted auger can be disengaged in minutes and the flightless rock auger 10 attached to the drilling rig. The flightless auger 10 is lowered and raised with the hydraulic boom so that only the weight of the auger 10 exerts pressure on the rock substrate defining floating pressure. Although pressure may be exerted on the auger 10 it is not necessary in that the weight of the auger 10 is sufficient to cut through hard material such as rock ledges. Usually it is sufficient to lower the flightless rock auger 10 into the hole and letting it rest or float on the hard substrate. Optionally the weight of the power unit and boom may rest on the auger 10 adding additional weight; however, the auger is still considered to float in that no hydraulic pressure is needed to cut through the rock. Because the auger 10 is operated at a very low rpm, typically up to 15 revolutions per minute, ("rpm"), and preferably about 3 to 10 rpm, little dust is formed in the operation. Moreover, the wear and tear on the equipment is reduced if not eliminated as compared with the conventional drilling methods. This provides a very safe method of forming a plug of material within the cylindrical cutting head 24 for removal from the posthole. Upon breaking through the hard substrate and forming a plug therefrom, the flightless rock auger 10 is lifted from the hole and the plug removed by prying the plug out of the cylindrical body 20 with the use of pry bars which are extended into the openings 54 in the top of the cylindrical cutting head 24.

As shown in Figures, the flightless rock auger shows a cutting head having a row of removable or replaceable teeth, preferably conical teeth, extending from the bottom edge of angled sockets mounted by welding onto the bottom of he cutting head. The sockets and teeth can be oriented in a staggered configuration with teeth angled forward at from 20 to 50 degrees and preferably about 35 degrees. Every third tooth can be angled up to 30 degrees in the horizontal plane outwardly pass the edge of the cutting head, angled up to 30 degrees in the horizontal plane inwardly pass the edge of the cutting head, or in alignment with the edge of the cutting head.

The teeth in the cutting head can be disposed at an angle or up to 45 degrees, and preferable at an angle of from about 20 degrees in and out from the sidewall edge. The teeth may be disposed at up to 90 degrees and more preferably from 70 to 75 degrees, and most preferably at about 73 degrees at a forward angle.

Figure 22:
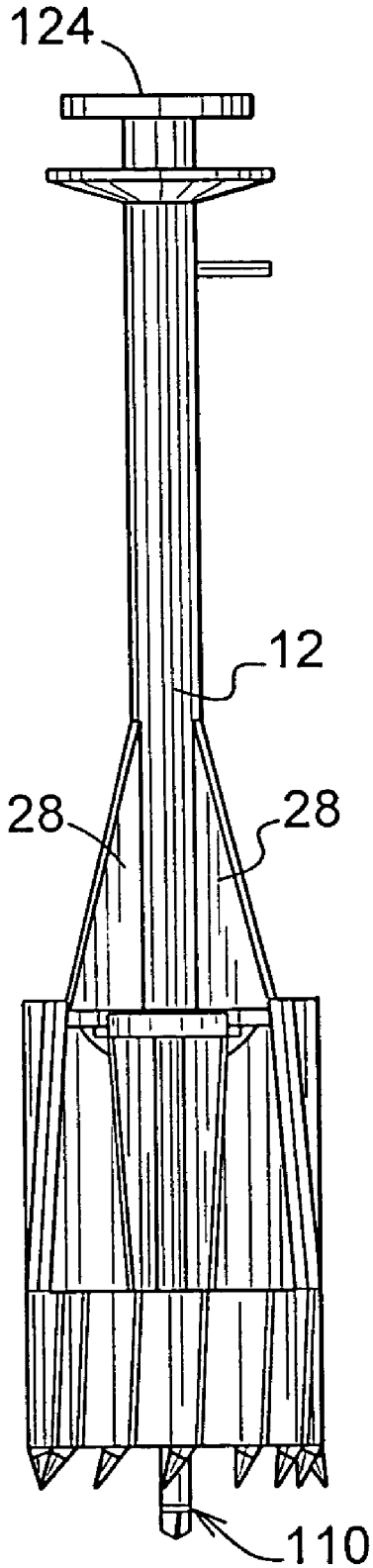
FIG. 22 is perspective front view of the flightless rock auger embodiment of FIG. 16 including the pilot bit as shown in FIG. 9 and showing the edges of the double sidewall cutaway portion of the body extending around the periphery thereof a selected length forming a double cutting or a sraping edge.
Figure 23:
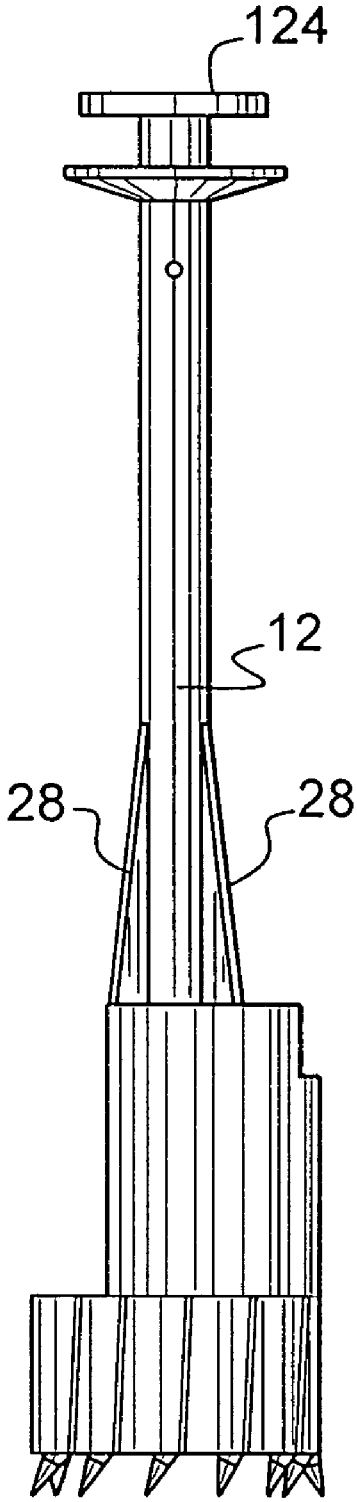
FIG. 23 is a perspective side view of the flightless rock auger embodiment of FIG. 16, showing a vertical cutting or a sraping edge along the cutaway portion of the cylindrical body.
Figure 24:
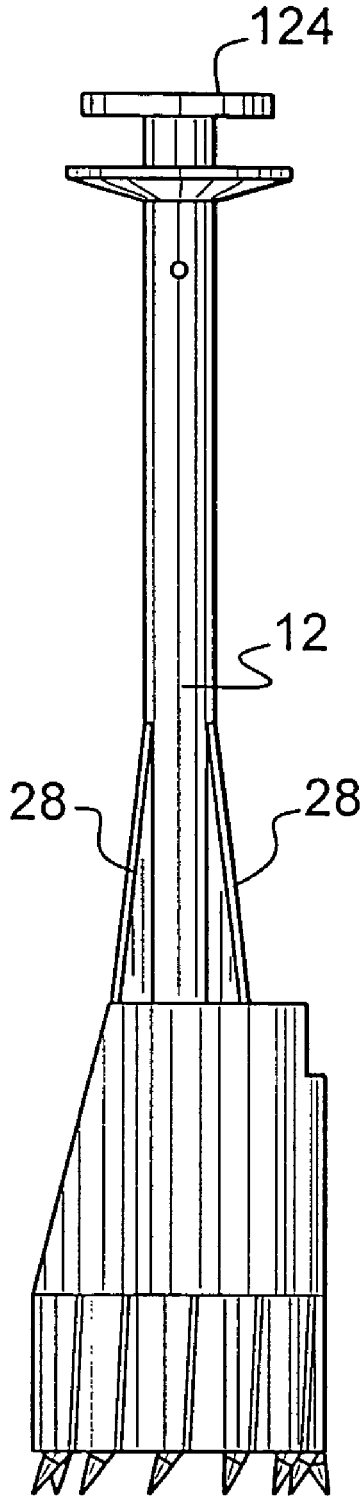
FIG. 24 is a perspective side view of the flightless rock auger embodiment of FIG. 16, showing an angled cutting or a sraping edge along the cutaway portion of the cylindrical body.
Figure 25:
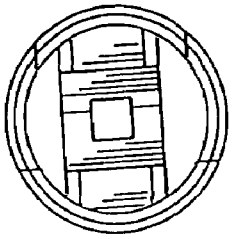
FIG. 25 is perspective top view of another embodiment of the flightless rock auger showing a coupling mounting directly to the top of the cylindrical body.
Figure 26:
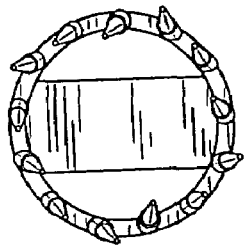
FIG. 26 is perspective bottom view of the flightless rock auger embodiment of FIG. 25 showing the angled teeth.
Figure 27:
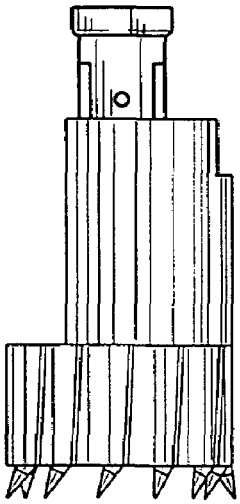
FIG. 27 is a perspective side view of the flightless rock auger embodiment of FIG. 25, showing a vertical cutting or a sraping edge along the cutaway portion of the cylindrical body.
Figure 28:
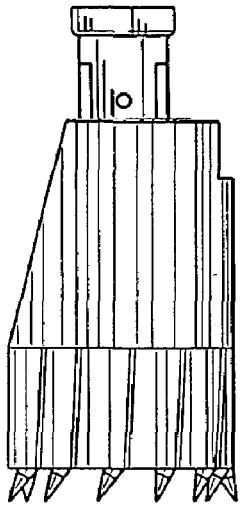
FIG. 28 is a perspective side view of the flightless rock auger embodiment of FIG. 25, showing an angled cutting or a sraping edge along the cutaway portion of the cylindrical body.
Figure 29:
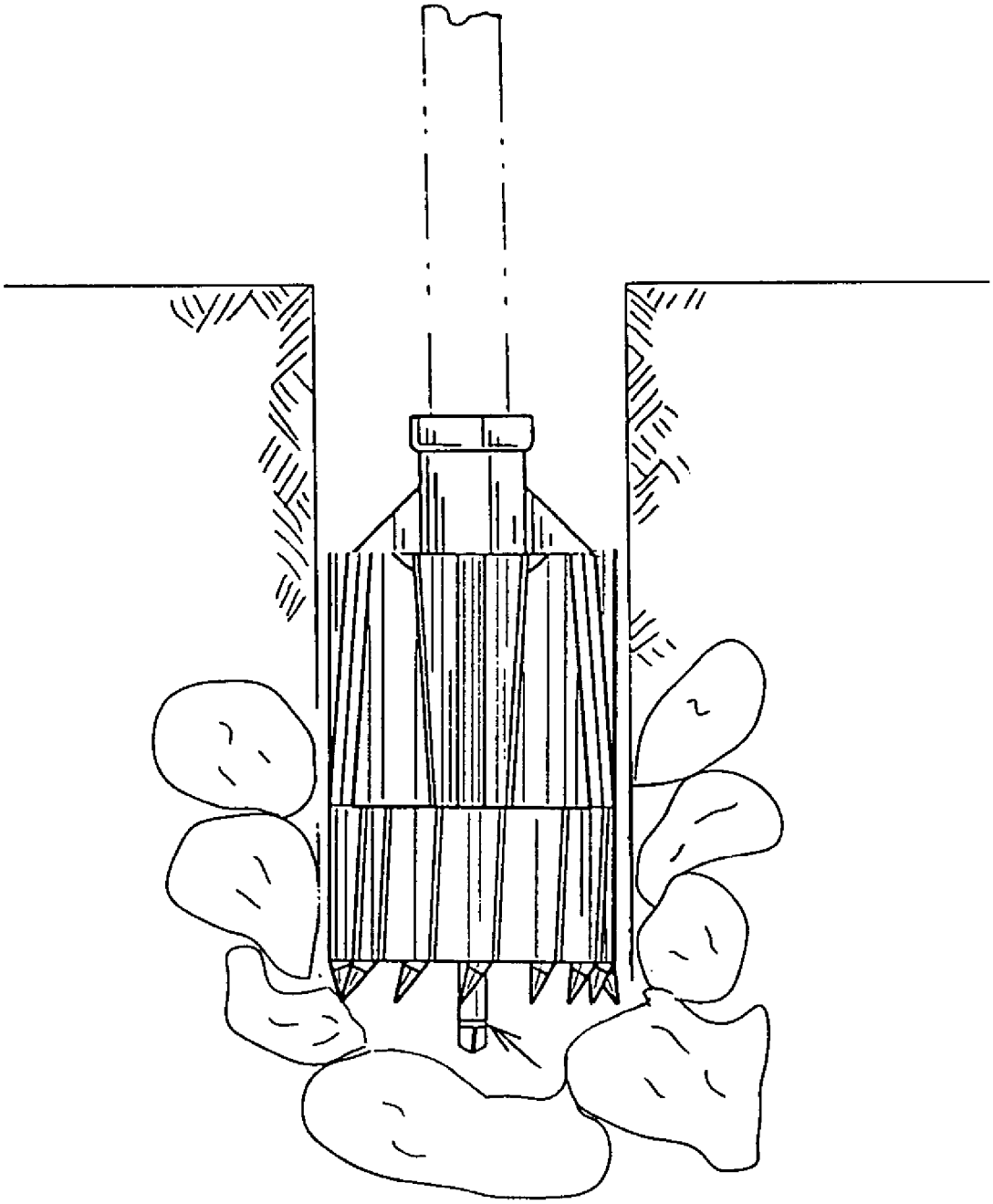
FIG. 29 is a perspective cutaway view of the flightless rock auger embodiment of FIG. 25 shown with a pilot bit and side edges extending into a bore formed in rock and soil.
Figure 30:
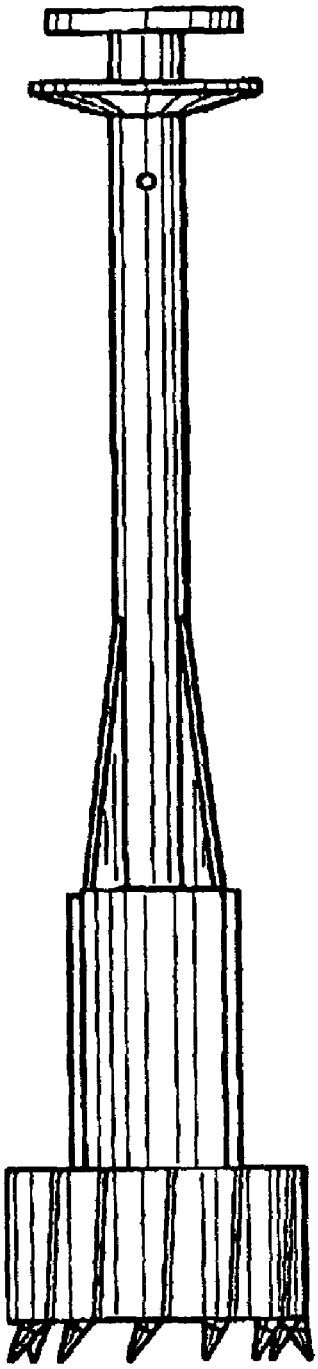
FIG. 30 is a perspective side view of the flightless rock auger embodiment shown having a long shaft, showing a vertical cutting or a sraping edge along the cutaway portion of the cylindrical body.
Figure 31:
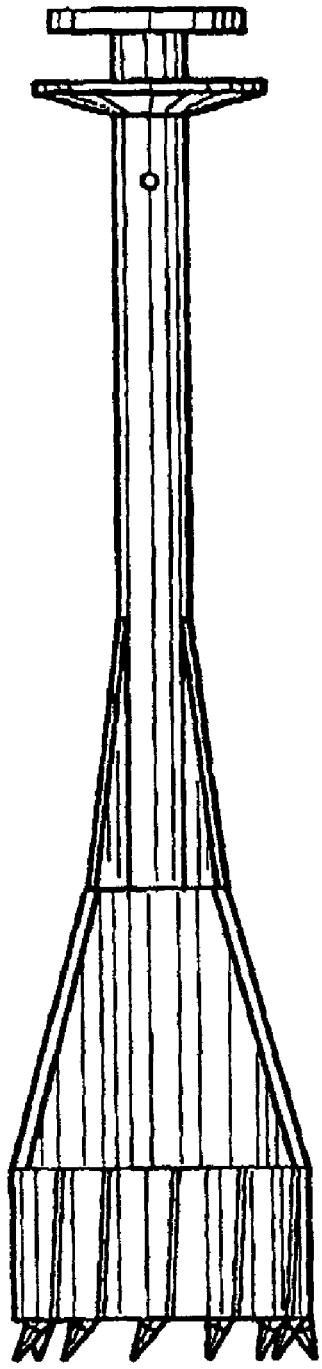
FIG. 31 is a perspective side view of the flightless rock auger embodiment of having a long shaft, showing an angled cutting or a sraping edge along the cutaway portion of the cylindrical body.
Figure 32:
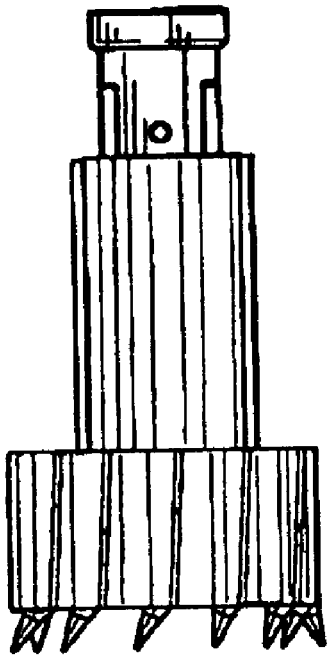
FIG. 32 is a perspective side view of the flightless rock auger embodiment having short connection coupling, showing a vertical cutting or a sraping edge along the cutaway portion of the cylindrical body.
Figure 33:
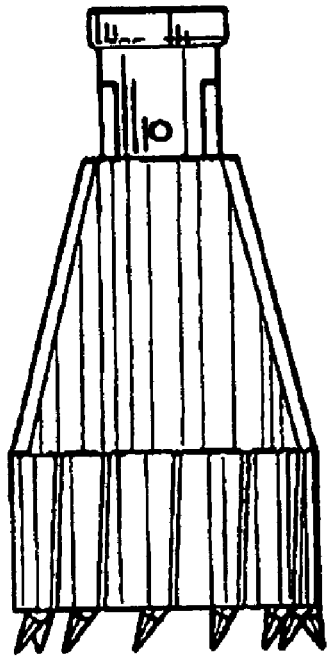
FIG. 33 is a perspective side view of the flightless rock auger embodiment having a short connection coupling, showing an angled cutting or a sraping edge along the cutaway portion of the cylindrical body.
Figure 34:
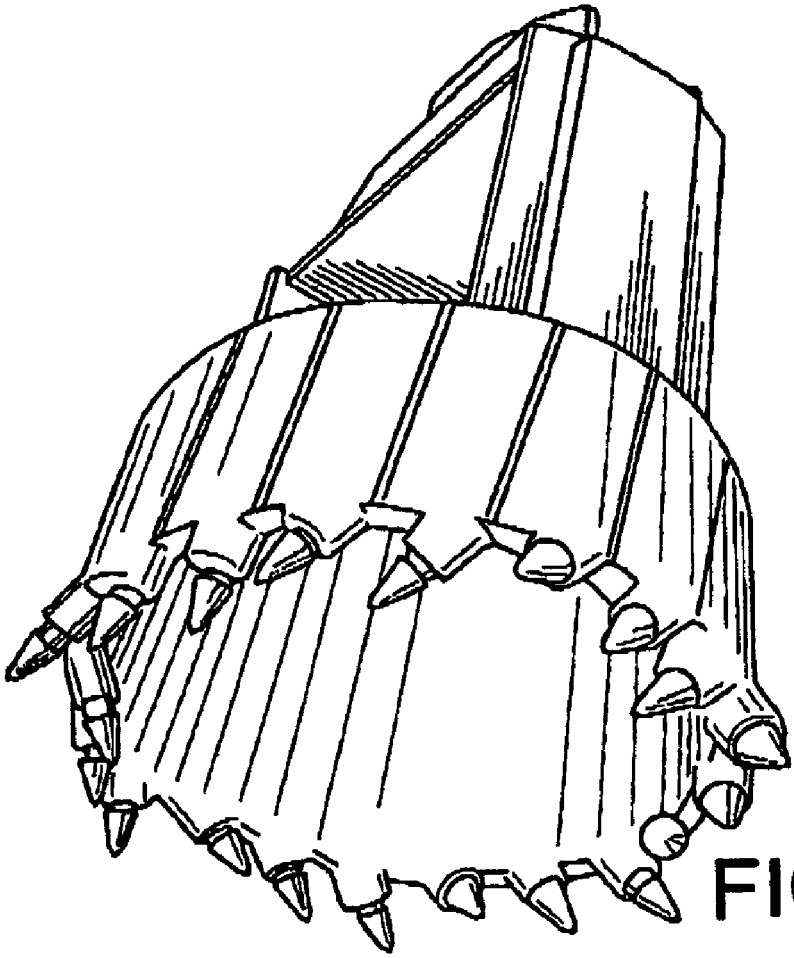
FIG. 34 is a perspective side view of the flightless rock auger embodiment having a short connecting coupling showing an opposing side cutaway openings.
Figure 35:
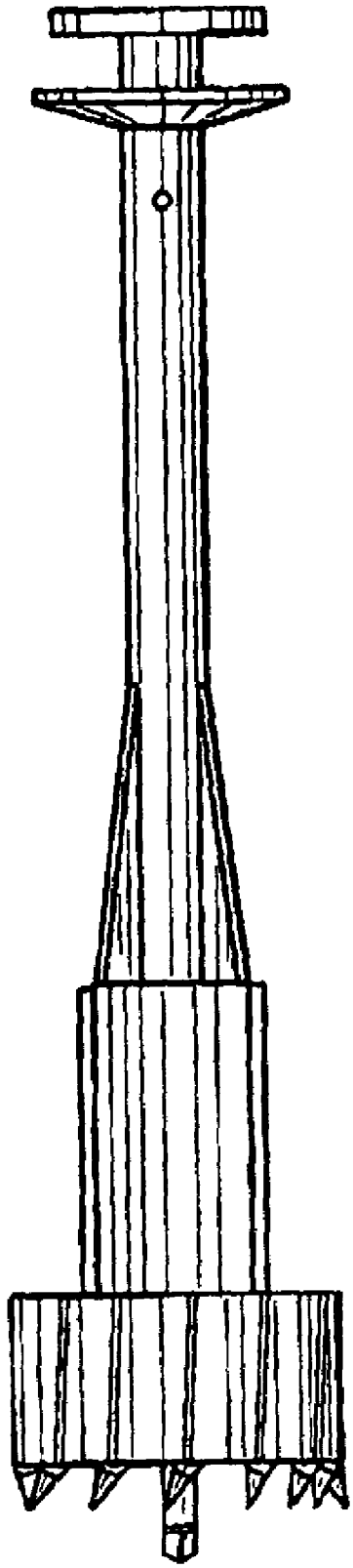
FIG. 35 is a perspective side view of the flightless rock auger embodiment having a long shaft and showing opposing cutting or a sraping edges along the cutaway portion of the cylindrical body.

FIG. 22 is a photograph showing a side view of a cutting head incorporating 18 teeth on an 18 inch diameter auger vs. 13 teeth on the initial embodiment of the invention providing a smoother cutting operation and smoother sidewalls on the hole formed thereby, also the cutting teeth are disposed at an angle extending inwardly and outwardly at 20 degrees which varies from the original embodiment, finally the cutting teeth are mounted in a range of from 70 to 75 degrees and preferably at about 73 degrees facing forward.

A preferred embodiment of the flightless rock auger comprises a cutting head can incorporate 18 teeth on an 18 inch diameter head or 13 teeth on an 18 inch diameter head. Eighteen teeth provide a smoother cutting operation and smoother sidewalls on the hole formed thereby. Also the cutting teeth can be disposed at an angle extending inwardly and outwardly preferably at about 20 degrees and be mounted in a range of from 70 to 75 degrees and preferably at about 73 degrees facing forward.

Moreover, as best illustrated in FIGS. 9–14, the cutting head of the auger includes a center drill bit or pilot bit 100. The pilot bit 100 can be removably mounted via a socket with a spring loaded ball arrangement, a pin extending through a shaft and coupling arrangement, or as shown in the drawings, have a base 102 attached to the support member. The support member connecting the side walls of the upper portion of the cutting head includes means for attachment defining a pair of bolts extending therethrough for attachment to the cutting head support member. The bottom of the base of the center drill bit can include a pair of side flanges 122 for alignment and cooperative engagement with the side edges of the cross member 21 of the cutting head. The edge of flanges 122 can engage the edge of the cross member 21.

The shaft 104 of the center drill or pilot bit is centrally disposed in spaced apart alignment with the sidewalls of the cutting head. The shaft 104 of the center drill bit can be formed as a single cylindrical longitudinal member or as a longitudinal member including a plurality of tapered support plates 106 (two or three or four or more) extending from the base. The shaft can attach to a point or be welded all along the vertical edge to the shaft end converging at a point near the drill tip. The tapered ends of the support plates end in a short cylindrical collar 111 having a thicker bottom portion 113 of a larger diameter than the elongated top portion 115. The distal end portion 115 can include a threaded bore 108 therein for cooperative engagement with a drill tip 110 having a complementary sized shaft 112. A drill head 114 can include angled edges 116 and a pointed tip 118 for cutting into hard surfaces such as rock.

The pilot drill bit 100 is mounted within the cutting head of the auger wherein the elongated top portion of the collar extends outward pass the cutting head approximately equal with the tips of the cutting head teeth. The pointed tip 118 extends pass the cutting teeth for centering and holding the auger in position in order for the cutting teeth to anchor and cut a precision hole into the hard rock substrate. The pilot drill bit 100 also provides a means for setting the flightless auger onto a flat hard rock surface. The pilot drill bit 100 cuts a center hole in the surface anchoring the flightless auger so that the cutting teeth are pulled therein. The bit 100 can cut into the substrate forming a neat round hole in the desired location rather than skidding or walking around on the surface before the hole sidewalls are established.

The bottom of the support member connecting the side walls at the top of the cutting head can have a plurality of tapered support plates attaching to the bottom of the cutting head support plate. The base of the drill bit 100 extending opposite thereof is disposed concentrically within the cutting head. The cutting head can have cutaway portions forming opposing openings 120 in the top portion of the cutting head cylindrical body. The openings 120 can extend from the corners of the cutting head support plate for providing access to the bolts for removal of the cutting drill bit and removal of the rock substrate plug from the cutting head.

The embodiment of the flightless rock auger shown in FIGS. 16–21, include a portion section of the side wall being removed from the upper section. The portion may be of uniform dimensions cut from top to bottom or angled as shown. The preferred embodiment shown also includes a double wall wherein one of the walls forms an angled side edge along the longitudinal lengthwise dimension resulting in a leading edge defining a side scraping edge or side cutting edge depending upon the bevel of the leading edge and method of use in a selected substrate; however, a single wall unit could have cutout portion formed with an angled sidewall edge as well. As best illustrated in FIG. 22, the unit can also be used with a pilot bit 110. The opening formed in the upper section extends from one corner of the cross member 21 which supports the base of the pilot bit to the adjacent corner of the cross member 21. The opposing sidewall could also be removed as long as the cutting head upper section retained sufficient structural strength so as not to buckle or collapse under a load. While the bottom section usually provides enough suction and compression to maintain a plug within the top section. The upper or top section cutout portion may be designed to maximize the opening depending upon the rock and/or clay substrate. Of course, suction is not a problem when the cutting head is removed from the hole and the large opening provides ample space and facilitates quick and efficient removal of the substrate from the cutting head. The cutting side edges also trim and cut substrate along the sides of the drilling head forming a clean hole having uniform smoother sidewalls. The lower section of the cutting head need not extend outwardly at a greater diameter than the upper section of the cutting head when the side edges are utilize. Moreover, the outwardly extending angle of the cutting teeth may be reduced or even eliminated when using the side cutting angle. The length or ratio of the upper and lower sections can also be customized for use in particular hard substrates.

Figure 19:
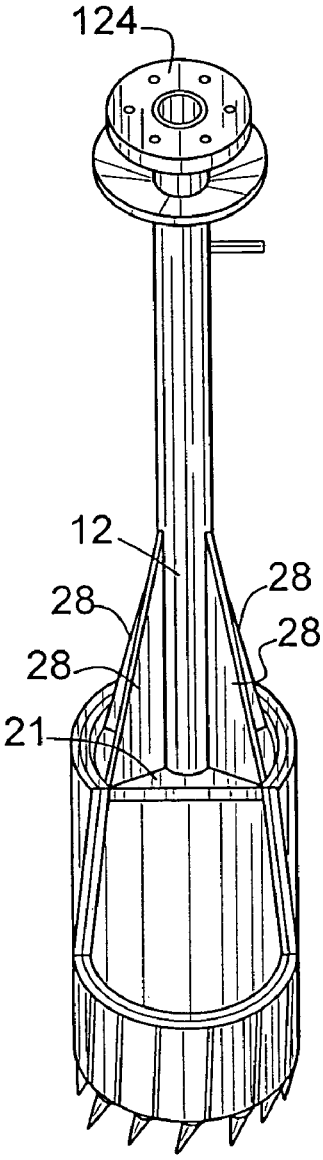
FIG. 19 is a perspective view of the flightless rock auger embodiment of FIG. 16 showing the double layer sidewall which may be optionally utilized to form a cutting or a sraping edge on the side of the cutting head and whereby the cylindrical body may be sized to be smaller than or as large as the cutting head.
Figure 16:
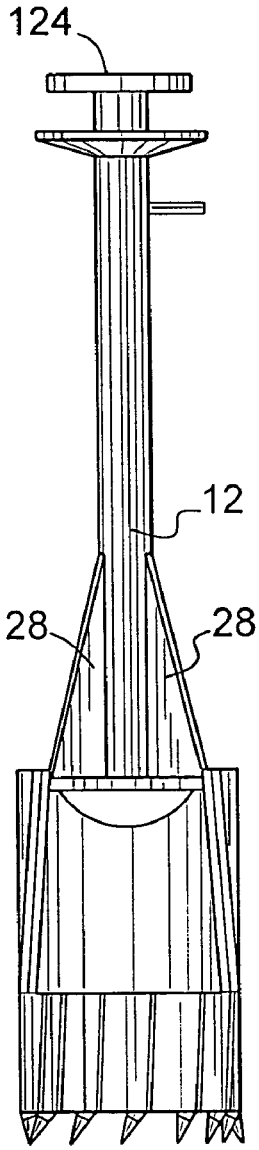
FIG. 16 is a front perspective view of another alternate embodiment of the flightless rock auger of the present invention showing the shaft with a quick disconnect distal end, a cylindrical body and drill head having a greater diameter than the body wherein a greater number of teeth extend downward at an selected angle from the outer edge of the drill head, and a section of the cutting head removed to facilitate removal of the plug.
Figure 17:
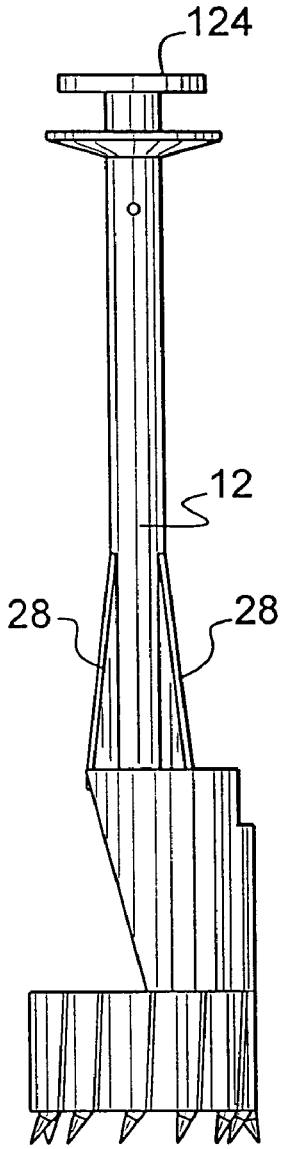
FIG. 17 is a perspective side view of the invention of the flightless rock auger embodiment of FIG. 16.
Figure 20:
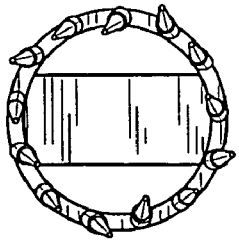
FIG. 20 is a perspective bottom view of the flightless rock auger embodiment of FIG. 16 showing the angled teeth.
Figure 21:
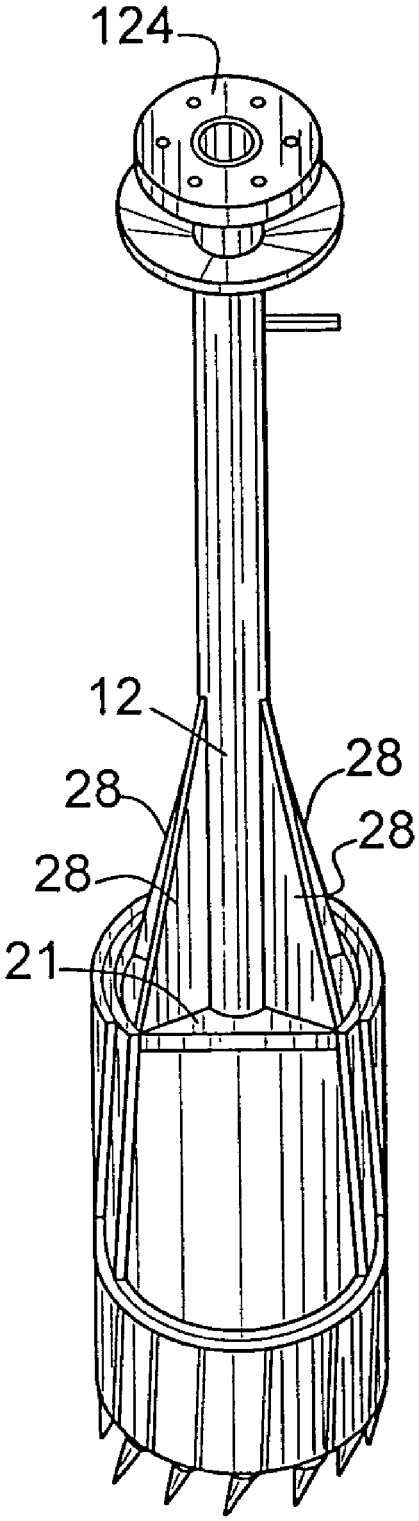
FIG. 21 is a perspective front view of the flightless rock auger embodiment of FIG. 16 showing the edges of the double sidewall cutaway portion of the body extending around the periphery thereof a selected length forming a double cutting or a sraping edge.

Comparing the embodiment of FIG. 19 with that of FIG. 21, it can be seen that the embodiment can include a double wall formed of two concentric layers overlapping one another. The cutaway section may result in both layers being removed creating a single cutting or scraping edge or one layer can have a greater circumference than the other layer thereby forming a pair of overlapping cutting or scraping edges spaced apart from one another. The layers of the walls form an angled side edge along the longitudinal lengthwise dimension resulting in a leading edge defining a side cutting or scraping edge or a thick double wall. Of course a single wall unit could have cutout portion formed with an angled sidewall edge as well.

The opening formed in the upper section extends from one corner of the cross member 21 which supports the base of the pilot bit to the adjacent corner of the cross member 21. The opposing sidewall could also be removed forming a double opening as long as the cutting head upper section retained sufficient structural strength so as not to buckle or collapse under a load. While the bottom section usually provides enough suction and compression to maintain a plug within the top section. The upper or top section cutout portion may be designed to maximize the opening depending upon the rock and/or clay substrate. Of course, suction is not a problem when the cutting head is removed from the hole and the large opening provides ample space and facilitates quick and efficient removal of the substrate from the cutting head. The cutting side edges also scrape, trim and cut substrate along the sides of the drilling head forming a clean hole having uniform smoother sidewalls. The lower section of the cutting head need not extend outwardly at a greater diameter than the upper section of the cutting head when the side edges are utilize. Moreover, the outwardly extending angle of the cutting teeth may be reduced or even eliminated when using the side cutting angle. The length or ratio of the upper and lower sections can also be customized for use in particular hard substrates.

The embodiments shown in FIGS. 25–29, show the cylindrical body of the cutting head with and without a pilot bit, and with a portion of the side wall being removed from the cylindrical body portion of the cutting head. All of the embodiments utilize a short coupling mounted directly to the support member extending across the top of the cutting head. Reinforcement members may be bolted or welded to the sides of the coupling and the support plate as well. This embodiment is especially adaptable for use with pressure drilling rigs.

The embodiments shown in Figures, include a second opening opposed to the first extending from the top edge of a bottom reinforcement band supporting the teeth to the top edge of the cutting body affixed to the support member. Of course, the opening could be sized or shaped depending upon the amount of open area desired or to maximize the side scraping or cutting area of the leading edge formed by the opening(s). Although three or more openings could be utilized with the present invention, structural strength as well as the ability to reach the plug formed within the cutting head with tools for removal of same are important considerations in determining whether one, two, or more openings are optimal for achieving a smooth bore at an optimal drilling rate. Of course, a pilot bit can be used with the multi-opening rock augers and the shaft may be a quick disconnect long shaft or the rock auger cutting head may only include a short coupling mounted directly to the support member extending across the top of the cutting head.

Finally it is contemplated that a number of smaller openings formed by holes, slots, or slits may be formed in the upper section of the drilling head as an alternate means to provide additional access to the substrate hole and provide drainage for water during the drilling process.

METHOD OF USE

The method of using the flightless rock auger is as follows: The method of removing a plug of hard substrate from a posthole, using a flightless rock auger with a drilling rig, comprising the steps of:

a) Attaching the flightless rock auger to the drive shaft of a power unit of the drilling rig, the flightless rock auger comprising a cylindrical hollow cutting head comprising a hollow cylindrical body defining side walls connecting a top end defining an upper peripheral edge and a lower open end defining a lower peripheral cutting edge including a plurality of teeth extending from the lower peripheral edge, the top end of the hollow cylindrical body including at least one support member extending across at least a portion of the top end joining the side walls, a quick disconnect coupling mounting to the at least one support member for removable attachment to a drive shaft of a power unit;

b) lowering the flightless rock auger into a posthole containing a hard substrate;

c) placing the flightless rock auger onto the hard substrate;

d) rotating the flightless rock auger at a very low rpm at less than 20 rpm;

e) forming a plug of hard substrate inside of the cylindrical body of the flightless rock auger;

f) lifting the flightless rock auger and the plug from the posthole; and g) removing the plug of the hard substrate out of the cylindrical hollow cutting head.

More particularly, a method of removing a plug of hard substrate from a posthole, using a flightless rock auger with a drilling rig, comprises the steps of:

a) attaching a flightless rock auger to the drive shaft of a power unit of the drilling rig, the flightless rock auger comprising a cylindrical hollow cutting head comprising a hollow cylindrical body defining side walls connecting a top end defining an upper peripheral edge and a lower open end defining a lower peripheral cutting edge including a plurality of teeth extending from the lower peripheral edge, the top end of the hollow cylindrical body including at least one support member extending across at least a portion of the top end joining the side walls, a means for connecting to a shaft comprising a quick connect coupling includes a proximal end connecting to the at least one support member and having an opposing distal end extending therefrom including means for removably connecting to a drive shaft of a power unit;

b) lowering the flightless rock auger into a posthole containing a hard substrate;

c) placing the flightless rock auger onto the hard substrate;

d) rotating the flightless rock auger at a very low rpm up to 20 revolutions per minute rpm;

e) forming a plug of hard substrate inside of the cylindrical body of the flightless rock auger;

f) lifting the flightless rock auger and the plug from the posthole; and g) removing the plug of the hard substrate out of the cylindrical hollow cutting head.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

We claim:

1. A rock auger comprising:

a drive shaft having a longitudinal axis, means at one end of said drive shaft for connecting a first end of said drive shaft to a power driven unit and a cutting head mounted on and projecting from a second end of said drive shaft, said cutting head including a side wall connecting a top edge and a bottom edge defining a tubular body disposed co-axial with said drive shaft and terminating in a free outer end spaced a selected distance from the second end of said drive shaft, a plurality of conical teeth mounted on said bottom edge of said side wall and extending from the free end thereof in an array about the periphery of an opening of selected diameter into a cavity defined by said side wall, said cavity being of selected depth for receiving therein a plug cut from said material by said teeth as said tubular body is rotated about said axis, said side wall having at least one opening extending from said top edge of said tubular body a selected distance there through forming a cutaway portion extending downwardly from said top edge.

2. An auger apparatus comprising:

a cutting head including a side wall defining a tubular body and end plate;

means at one end of said cutting head for connecting said end plate to a power driven unit;

a plurality of teeth mounted on said side wall extending from the free end thereof in an array about the periphery of an opening of selected diameter into a cavity defined by said side wall, said cavity being of selected depth for receiving therein a plug cut from said material by said teeth as said tubular body is rotated about an axis, said side wall including an opening defining a cutaway portion including lateral edges;

said body includes a cutaway portion extending around the periphery thereof a selected length forming an edge extending along a portion of said side wall generally disposed at an angle and generally parallel to said axis.

3. The auger apparatus of claim 2, further comprising a pilot drill extending from said end plate, said pilot drill disposed within said tubular body and extending in axial alignment therewith.

4. The auger apparatus of claim 3, wherein said pilot drill extending pass said teeth extending from said lower peripheral edge of said cutting head.

5. The auger apparatus of claim 3, wherein said pilot drill includes a removable tip.

6. The auger apparatus of claim 3, wherein said distal end of said pilot drill shaft ends in a short cylindrical collar including means for removably attaching said drill tip.

7. The auger apparatus of claim 3, wherein means at one end of said cutting head for connecting said end plate to a power driven unit comprises a socket shaped for cooperatively engaging a drive shaft having a diameter less than said cutting head, said drive shaft including a proximal end cooperatively engaging said socket of said end plate and having an opposing distal drive end extending therefrom.

8. An auger apparatus comprising:

a cutting head including a side wall defining a tubular body and end plate;

means at one end of said cutting head for connecting said end plate to a power driven unit;

a plurality of teeth mounted on said side wall extending from the free end thereof in an array about the periphery of an opening of selected diameter into a cavity defined by said side wall, said cavity being of selected depth for receiving therein a plug cut from said material by said teeth as said tubular body is rotated about an axis, said side wall including an opening defining a cutaway portion including lateral edges;

said body includes a cutaway portion extending around the periphery thereof a selected length forming an edge extending along a portion of said side wall generally disposed at an angle and generally parallel to said axis.

9. An auger apparatus comprising:

a cutting head including a side wall defining a tubular body and end plate;

means at one end of said cutting head for connecting said end plate to a power driven unit;

a plurality of teeth mounted on said side wall extending from the free end thereof in an array about the periphery of an opening of selected diameter into a cavity defined by said side wall, said cavity being of selected depth for receiving therein a plug cut from said material by said teeth as said tubular body is rotated about an axis, said side wall including an opening defining a cutaway portion including lateral edges;

said means for connecting includes an end plate connecting to at least a portion of said side wall forming said tubular body of said cutting head opposite said teeth, joining at least two points of said side wall;

a pilot drill extending from an end plate, said pilot drill disposed within said tubular body and extending in axial alignment therewith; and means for reinforcing and bracing said pilot drill shaft mounting to said bottom surface of said end plate.

10. The auger apparatus of claim 9, wherein said means for reinforcing and bracing said pilot drill shaft comprises at least one reinforcing member extending from said bottom surface of said mounting end plate and attaching to at least one selected point of said pilot drill shaft.

11. The auger apparatus of claim 9, wherein said means for reinforcing and bracing said pilot drill shaft comprises a plurality of tapered support plates having a broad base extending from said bottom surface of said mounting end plate and a tapered end attaching to said selected point of said pilot drill shaft.

12. The auger apparatus of claim 11, wherein said tapered support plates are welded all along the edge to said pilot drill shaft extending to a point near said drill tip.

13. An auger apparatus comprising:

a cutting head including a side wall defining a tubular body and end plate;

means at one end of said cutting head for connecting said end plate to a power driven unit;

a plurality of teeth mounted on said side wall extending from the free end thereof in an array about the periphery of an opening of selected diameter into a cavity defined by said side wall, said cavity being of selected depth for receiving therein a plug cut from said material by said teeth as said tubular body is rotated about an axis, said side wall including an opening defining a cutaway portion including lateral edges;

said tubular body further comprising a double side wall having an overlapping lateral cutaway portion stagged forming a double edge.

14. An auger apparatus comprising:

a cutting head including a side wall defining a tubular body and end plate;

means at one end of said cutting head for connecting said end plate to a power driven unit;

a plurality of teeth mounted on said side wall extending from the free end thereof in an array about the periphery of an opening of selected diameter into a cavity defined by said side wall, said cavity being of selected depth for receiving therein a plug cut from said material by said teeth as said tubular body is rotated about an axis, said side wall including an opening defining a cutaway portion including lateral edges;

said cutaway portion of said tubular body extends around the periphery thereof a selected length extending from a lower peripheral cutting edge toward said end plate, said cutaway portion forming at least one lateral cutting edge.

15. An auger apparatus, comprising:

a cylindrical hollow cutting head comprising a hollow cylindrical body defining side wall connecting to an end plate extending between said side wall enclosing at least a portion of a top end of said hollow cylindrical body, and a lower open end defining a lower peripheral cuffing edge including a plurality of teeth extending from said lower peripheral edge;

said side wall of said hollow cylindrical body including at least one opening therein;

a drive shaft having a diameter less than said cuffing head, said drive shaft including a proximal end connecting to a top surface of said end plate and having an opposing distal drive end extending therefrom; and a pilot drill extending from a bottom surface of said end plate, said pilot drill disposed within said cylindrical hollow cuffing head and extending in axial alignment with said drive shaft;

said pilot drill having a removable tip;

said pilot drill extending pass said teeth extending from said lower peripheral edge of said cutting head; and a cutaway portion of the body extending around the periphery thereof a selected length forming an opening extending along a portion of said side walls extending from said lower peripheral cutting edge to a selected point of said end plate, said cutaway portion forming an angled lateral side wall edge.

16. An auger apparatus, comprising:

a cylindrical hollow cutting head comprising a hollow cylindrical body defining side wall connecting to an end plate extending across and joining said side wall enclosing at least a portion of said hollow cylindrical body, said cylindrical hollow cutting head having a lower open end defining a lower peripheral cutting edge including a plurality of teeth projecting from said lower peripheral cutting edge;

means for cooperatively engaging a drive shaft extending from a top surface of said end plate;

a cutaway portion of the body extending around the periphery thereof a selected length forming an opening extending along a portion of said side walls extending from said lower peripheral cutting edge to said end plate, said cutaway portion forming a lateral side wall edge. said hollow cylindrical body further comprising a double side wall having an overlapping lateral cutaway portion stagged forming a double side wall edge.

* * * * *